US007721665B2

(12) United States Patent
Schreiber

(10) Patent No.: US 7,721,665 B2
(45) **Date of Patent: *May 25, 2010**

(54) HULL AND STEERING MECHANISM FOR A MARINE VESSEL

(75) Inventor: Dennis Schreiber, Scranton, NC (US)

(73) Assignee: AJ Marine, Inc., Kingsville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/386,987

(22) Filed: Apr. 24, 2009

(65) Prior Publication Data

US 2009/0211506 A1 Aug. 27, 2009

Related U.S. Application Data

(63) Continuation of application No. 11/228,429, filed on Sep. 15, 2005, now Pat. No. 7,536,968.

(51) Int. Cl.

| | |
|---|---|
| ***B63H 25/06*** | (2006.01) |
| *B63B 1/00* | (2006.01) |
| *B63B 3/38* | (2006.01) |
| *B63H 1/18* | (2006.01) |
| *B63H 1/16* | (2006.01) |

(52) U.S. Cl. ..... 114/163; 114/61.13; 114/140; 114/162; 440/66; 440/67

(58) Field of Classification Search ..... 114/61.13, 114/140, 151, 162–166, 288–290; 440/66, 440/67

See application file for complete search history.

(56) References Cited

U.S. PATENT DOCUMENTS

| | | | | |
|---|---|---|---|---|
| 2,043,276 | A * | 6/1936 | Wellons | 114/162 |
| 3,828,713 | A | 8/1974 | Duryea | |
| 3,995,575 | A | 12/1976 | Jones, Jr. | |
| 4,609,360 | A * | 9/1986 | Whitehead | 440/69 |
| 5,102,359 | A | 4/1992 | Hinds | |
| 5,359,958 | A | 11/1994 | Guild | |
| 5,558,036 | A | 9/1996 | Hara | |
| 6,976,444 | B1 | 12/2005 | Seiford, Sr. | |

* cited by examiner

*Primary Examiner*—Daniel V Venne
(74) *Attorney, Agent, or Firm*—Abelman, Frayne & Schwab

(57) ABSTRACT

A combined hull and steering mechanism for a marine vessel has a substantially rectangularly-shaped upper hull joined to a lower hull that is dual-tapered from its sidewalls to both its forward and aft portions. A directional thrust steering mechanism having a pair of vertical rudder blades positioned on either side of a conventional propeller extending from the centerline of the lower hull directs the water from the propeller, thus enabling the vessel to move more efficiently and with greater maneuverability in both forward and reverse directions. The dual-tapered hull permits a significantly better flow of water to and from the propeller and steering mechanism of the vessel, particularly when operating in reverse, thereby allowing the vessel to turn 360° in its own length.

20 Claims, 3 Drawing Sheets

HULL AND STEERING MECHANISM FOR A MARINE VESSEL

CROSS REFERENCE TO RELATED APPLICATIONS

This application is a continuation of U.S. application Ser. No. 11/228,429, filed Sep. 15, 2005, now U.S. Pat. No. 7,536,968, entitled "Hull And Steering Mechanism For A Marine Vessel", which is fully incorporated by reference herein.

BACKGROUND OF THE INVENTION

1. Field of the Invention

This invention relates to a combined hull and steering mechanism for marine vessels and particularly for a special purpose marine vessel that is commonly used to move work barges and other similar craft required for the construction of piers, docks and other marine structures, this craft being referred to in the maritime trade as a "pushboat".

2. Description of the Related Art

Pushboats are essential vessels required in the construction of piers, docks and the like. A pushboat must be highly maneuverable and must be able to move other large marine vessels, such as barges, in the typically tight surroundings of a construction project. Pushboats are relatively small and manned by a single operator.

Pushboats have been used on the aforementioned types of jobs for many years. The name pushboat is derived from a large flat vertical plate that extends across the bow, which can make stable contact with the flat side hull of a barge, floating dock or the like, to provide a broader area of contact, and therefore stability during the maneuvering operation. The distinctive feature of the pushboat is its flat bow surface, or prow, which distinguishes it from a tug boat and other work boats that have a more traditional hydrodynamically tapered or pointed bow that is more efficient for forward movement.

One problem with pushboats, however, is the fact that the flat bow plate limits maneuverability of the boat through water as there is a significant amount of lateral resistance encountered when such a vessel is turned. Typically, additional rudders known as flanking rudders, are required to aide in the steering of pushboats to compensate for this lack of maneuverability. They are positioned outboard and forward of the propeller One object of the present invention is to provide a marine vessel which is less resistant to lateral forces of the water when turning and thus has much greater maneuverability and is faster than other marine vessels of similar shape and size.

Another object of the present invention is to provide a marine vessel having a hull that is configured to allow the vessel to turn in a tighter pattern and to move more efficiently than other marine vessels of similar size and function.

Still another object of the present invention is to provide a marine vessel which is capable of coming about 180 degrees, and even of turning 360 degrees, in its own length.

SUMMARY OF THE INVENTION

These and other objects and advantages are achieved by the novel pushboat hull of the invention that is comprised of an upper and a lower portion whose shapes differ markedly from each other. The upper portion of the hull which is sometimes referred to as the upper hull, is generally rectangular in shape and overhangs a lower, dual-tapered hull. As used herein, the term "dual-tapered hull" means a hull having side walls that meet by tapering inwardly and are joined at the longitudinal center line, or the line defined by the keel of the boat. The hull rises towards the bow at an angle from a flat bottom, beginning at a transverse line about one-third of the length of the longitudinal axis from the bow of lower hull. The forward end of the lower dual-tapered hull is configured as a flat, triangular surface, which results in lift and less resistance when the vessel is moving forward.

The novel hull configuration of the invention significantly minimizes the lateral resistance encountered by prior art boats such as those disclosed in U.S. Pat. No. 3,822,661 issued Jul. 9, 1974, U.S. Pat. No. 6,112,687 issued Sep. 5, 2000 and U.S. Pat. No. 6,834,605 issued Dec. 28, 2004. Boats of the prior art generally disclose the concept of implementing a ship hull having two main hull portions that take the form of a relatively flat upper hull mounted above a lower portion formed of a smaller, rounded or cylindrical section attached to the underside of the upper hull.

However, the combined hull and steering configuration of the present invention is significantly superior to any of the claimed configurations of the prior art. One difference is that the lower portion of the hull is dual-tapered, that is, its oblong shape tapers from its outermost widest section, with the sides intersecting at a generally vertical line at the forward and aft ends. Tapering the aft or rear end of the lower dual-tapered hull permits a significantly better flow of water to the propeller and steering mechanism by drawing water toward the propeller as opposed to away from it as with conventional hull designs that are either generally flat and not tapered at all or are tapered only in the bow or forward end of the hull. This eliminates the need for additional rudders to steer the vessel as are generally used in the prior art. The aft end of the dual-tapered hull also eliminates the need for external supports for the propeller shaft housing, as depicted, for example, in U.S. Pat. No. 3,822,661. This configuration results in improved hydrodynamic flow, decreased lateral resistance and improved maneuverability.

The dual-tapered configuration is of particular importance when the combination of the partially enclosed directional thrust steering mechanism of the invention is employed to shorten the turning radius and the space required to maneuver the pushboat. A particular advantage of the hull design of the invention is realized when the propeller of the pushboat is reversed, since the tapered aft section allows the forces of the thrust from the propeller to flow either up both sides of the lower hull or to be applied away from, or along either of the side walls of the lower hull portion. This efficiency of operation is not possible where the lower hull transom is flat and extends a significant distance across the width of the aft portion of the hull, as is typically found in vessels of the prior art.

The enclosed directional thrust steering mechanism is adapted for use in combination with a conventional screw propeller. The steering mechanism is comprised of two parallel fin-type blades, one on each side and outboard of a screw propeller. The blades are both connected to a single steering mechanism post. The distance between the blades is sufficient to allow turning of the steering mechanism without contacting the propeller.

The steering mechanism post or shaft is rotatable about a vertical axis, which is directly above, and perpendicular to the horizontal axis of the screw propeller. A significant portion of the rudder blades extends forward of the vertical axis of the steering mechanism post. Such positioning allows for the thrust of the propeller to be directed more efficiently when said propeller is rotated in the reverse direction.

In a particularly preferred embodiment, the vertical projection of the axis of rotation of the steering post and attached mechanism passes through plane of rotation of the propeller. The geometry and dimensions of the steering assembly can readily be determined based upon the size of the propeller and its extension from the aft end of the lower hull. The transverse width of the steering assembly must be sufficient to avoid contact with the rotating propeller when the assembly is in the maximum port or starboard position.

While the submerged dual-tapered hull is designed to minimize lateral resistance, the twin fin directional thrust steering mechanism maximizes the lateral forces needed to turn the vessel in the desired direction.

It has been found that enclosing the propeller in a tube or other confining structure can result in undesirable cavitation when the propeller rotational speed exceeds a specified rpm value. Cavitation produces vibration and results in a loss of efficiency. Since the type of work performed by pushboats often requires maximum power and corresponding maximum rpm output of the engine, cavitation is to be avoided.

In a preferred embodiment, the area between the lower edges of the twin rudder fins and beneath the propeller is open to avoid cavitation. This preferred open configuration can be utilized when the pushboat will be working or moored in water whose depth is expected to preclude grounding. If grounding is a possibility during low tide conditions or where the depth is variable or unknown and it is desired to protect the propeller in the event of grounding, a plate can be attached below the propeller and the directional steering assembly. The protective plate is configured to minimize the restriction of water flow and thereby to avoid cavitation. In a preferred embodiment, the plate is detachably installed using releasable fasteners, such as bolts secured to threaded studs or rods that are suspended from one or both of the hulls. Removal of the plate permits easy access to the propeller, its driveshaft and bearing in the event that repairs are required.

As will be understood from the above, a pushboat or any other marine vessel having a directional thrust steering mechanism as described for a single fixed screw propeller that extends from a dual-tapered lower hull, effectively permits the pushboat to turn 180 degrees, or even 360 degrees, in its own length, a maneuver that is not possible in any known watercraft of the prior art.

BRIEF DESCRIPTION OF THE DRAWINGS

Preferred embodiments of the invention are further described with reference to the drawings, in which:

FIG. 7 is a top plan view of said directional thrust steering mechanism, the top and bottom being similar;

DETAILED DESCRIPTION OF THE INVENTION

Figure 1:
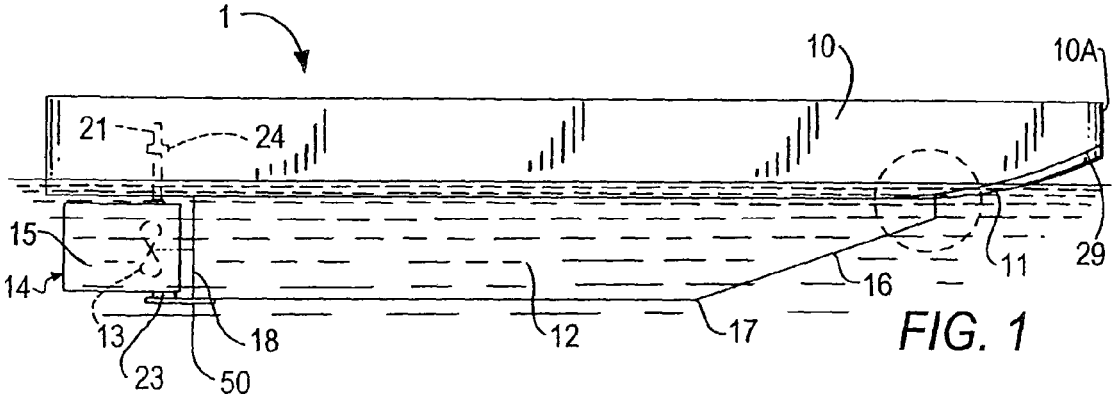
FIG. 1 is a side elevational view of a vessel having a hull and steering mechanism configured in accordance with the present invention.

The invention is further described with specific reference directed to a combined hull and steering mechanism configured for the special purpose marine vessel referred to as a pushboat. Referring to FIG. 1, there is illustrated a pushboat 1 provided with an upper hull portion 10, which overhangs the lower dual-tapered hull portion 12. An enclosed directional thrust steering mechanism 14 is positioned between the aft end 18 of the lower dual-tapered hull and the aft end of upper hull portion.

The upper hull 10 has a forward and aft section, and a top, bottom and sidewalls, it is generally rectangular and flat on the bottom, but may also be rounded in an alternative embodiment (not shown). The forward section 11 of the upper hull rises above the waterline to meet the bow surface 10A at the outside corners 29 of the upper hull, which eliminates the generally wide, flat submerged bow employed by the prior art. This configuration allows the water to pass under the vessel with a minimum of resistance, eliminating the resulting bow wave and loss of performance characteristics and efficiency when moving in the forward direction that is associated with craft of the prior art. This configuration also reduces lateral resistance while turning and improves maneuverability.

For the purposes of this description, a vessel having a nominal length L of about 25 feet, a beam W of 10 feet and a draft D of 3 feet is described. The lower hull can be 30 inches deep and the upper hull is submerged about 6 inches. A 210-horsepower diesel engine mounted in the lower hull will provide adequate power for a steel vessel of this configuration.

Figure 2:
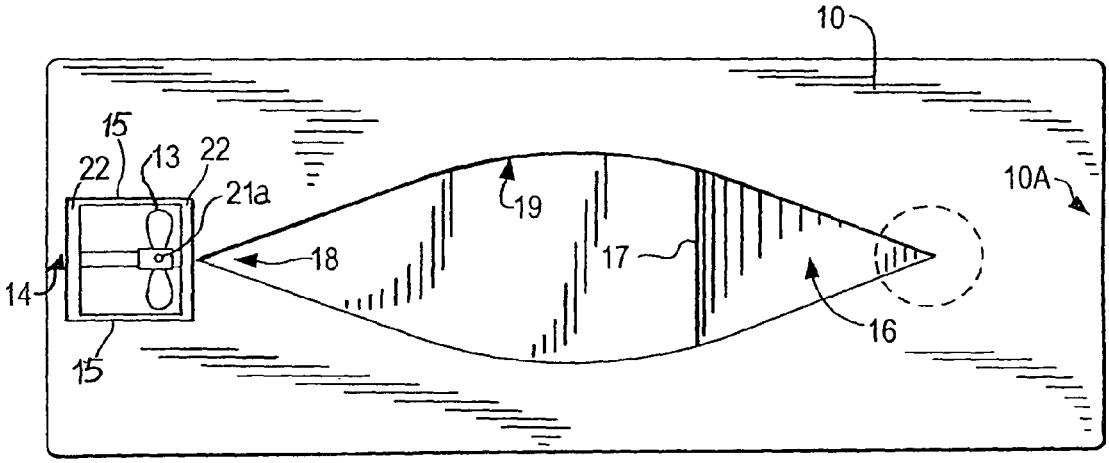
FIG. 2 is a bottom view of said vessel.
Figure 3:
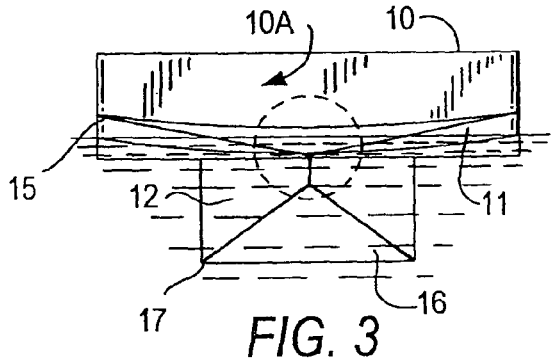
FIG. 3 is a front elevational view of said vessel.

As can be readily seen in FIG. 2, the lower dual-tapered hull 12 is displaced aft of bow surface 10A a distance of about four feet or about 15% of the overall length of the vessel. The lower hull is attached to upper hull 10, as by welding. This reduction in the overall length of the lower hull also greatly reduces lateral resistance encountered when turning the vessel. The forward bottom section 16 of the dual-tapered hull is angled upwardly along a transverse line 17 that is displaced a distance of about one-third of the lower hull's length from the bow, or about 5.5 feet, to form a substantially triangular section that produces lift when moving in the forward direction and that also serves to substantially reduce lateral resistance when turning as compared to prior art pushboat configurations. The forward bottom section of the dual-tapered hull is best seen in FIG. 3 and illustrates how it would cut through the water thereby reducing lateral resistance when turning.

The hydrodynamic shape of the dual-tapered hull 12 allows the water to flow freely past the aft tapered end 18 to the propeller 13 and to enter the area of the steering mechanism, or rudder assembly, 14 as the vessel moves forward.

Figure 4:
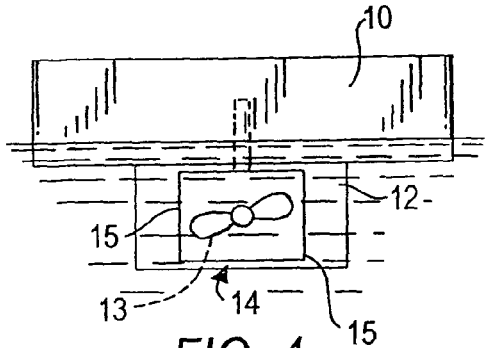
FIG. 4 is a rear elevational view of said vessel.
Figure 5:
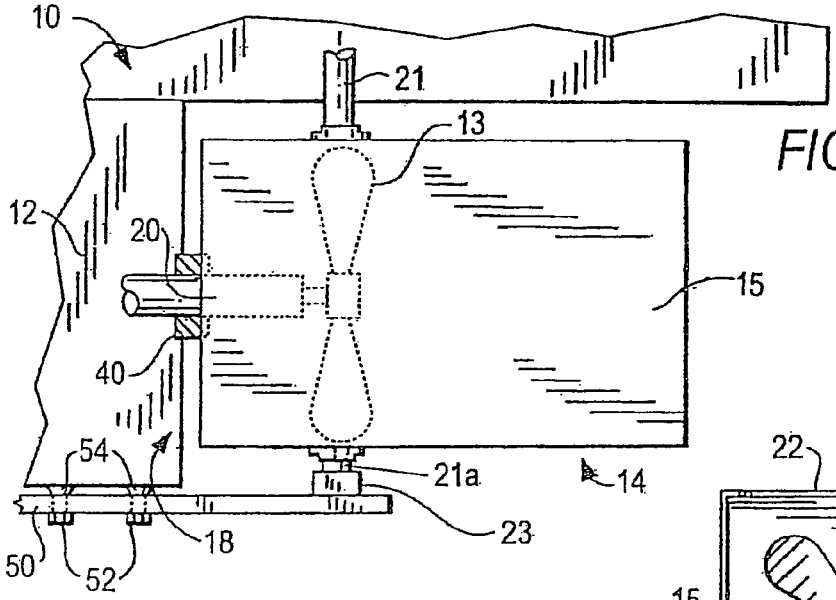
FIG. 5 is a side elevational view of a preferred embodiment of the directional thrust steering mechanism.

FIGS. 4 and 5 depict the positioning of the steering mechanism 14 behind the aft tapered end 18 of the lower hull 12. The propeller drive shaft 20 extends through a waterproof bearing seal 40 mounted in the lower hull. The propeller is displaced aft of the lower hull a distance that is sufficient to permit rotation of the steering assembly to direct the water from the propeller past the side of the hull in reverse.

Figure 6:
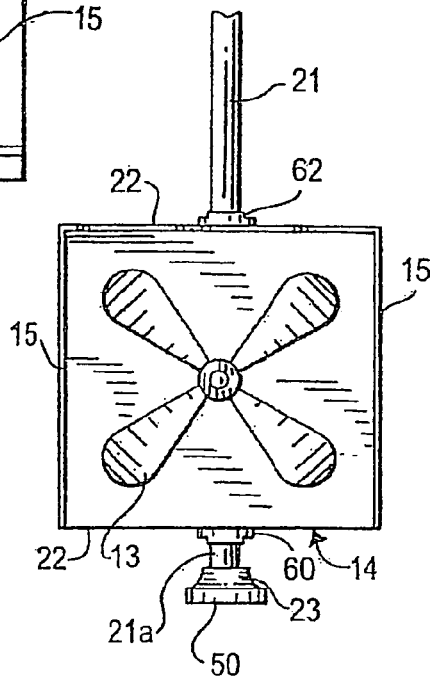
FIG. 6 is a rear elevational view of the steering mechanism.

In the pushboat of this example, the rudder blades 15 are about 3.5 feet long and 2.5 feet high. A vertically disposed support strut or post 21, as shown in FIGS. 5 and 6, secures the dual fin steering mechanism 14 in position aft of the dual-tapered lower hull. In the preferred embodiment illustrated, a second supporting cup bearing 23 is positioned below the steering mechanism and is attached to a strut 50 extending from and attached to the lower hull by mechanical fasteners 52 with vibrational dampers 54, or by welding (not shown).

Figure 7:
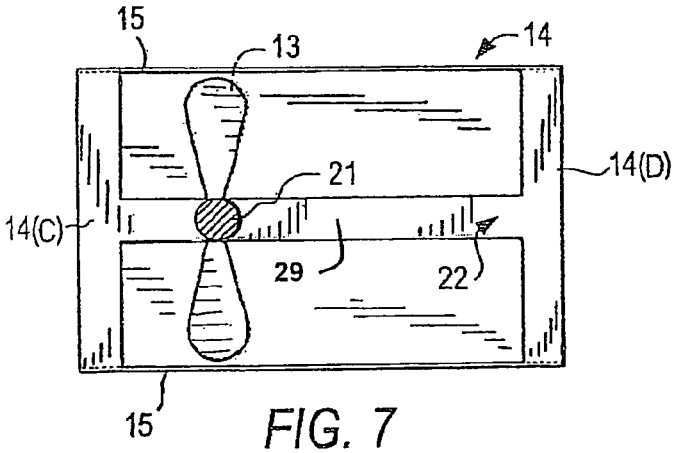

As the pushboat 1 is driven through the water by the propeller 13, the directional thrust steering mechanism 14 becomes effective in two respects. First, as can be seen in FIGS. 6 and 7, by having the two fin-like blades 15 positioned parallel on each side of propeller 13, the thrust from the propeller is concentrated and there is a substantial increase in efficiency and performance. By connecting the parallel blades 15 with relatively thin, flat structural members 22, the top and bottom portions of the steering mechanism 14 are not adversely affected by restricted water flow between the blades as may be the case in enclosed steering mechanisms of the prior art that employ round or tubular sections. The relatively thin, flat structural members 22 include a pair of linking members 14(C), 14(D) joined to, and extending transversely between the fore and aft portions of the upper and lower edges of the rudder blades 15 and a longitudinal linking member 29 extending longitudinally between each of the transverse linking members 14(C), 14(D) to form an open framework, and thereby maintain the rudder blades 15 in a parallel configuration. Second, as the pushboat 1 is turned to maneuver, one blade, provides directional thrust by diverting the water displaced by the propeller 13 in the desired direction and the other blade, provides lateral resistance which aids in the turning of the vessel. The combination provides exceptional maneuverability not possible with constructions of the prior art and permits the craft of the invention to complete a 180° turn, or even a 360° turn, on its own length.

Figure 8:
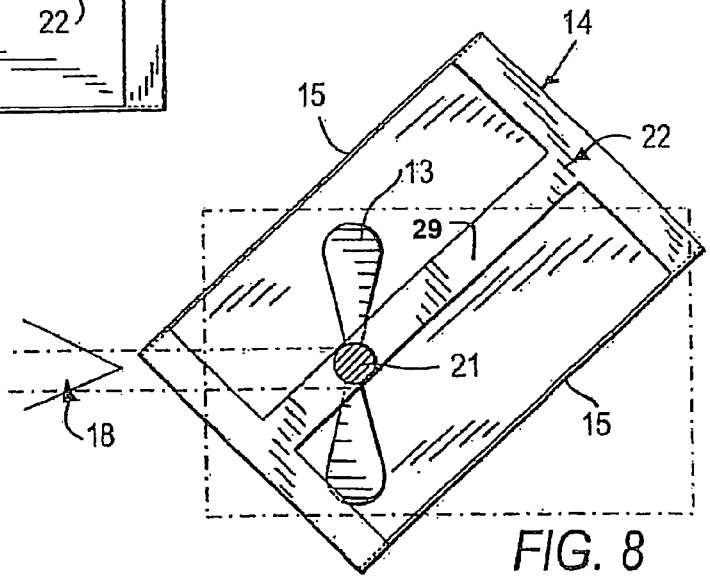
FIG. 8 is a top plan view, partly in phantom, showing the aft end of the dual-tapered hull with the steering mechanism turned hard to port.

Referring to FIG. 8, when the propeller 13 is rotating in the reverse direction, it is significant to note that the steering mechanism 14 can be turned so that the thrust is directed completely to either side of the dual-tapered hull 12 at the aft tapered end 18. The effect of the dual rudder elements and the directional thrust, when combined with the dual-tapered hull 12 produces a greater degree of maneuverability for the vessel of the invention than has been obtainable with the vessels of the prior art.

Figure 9:
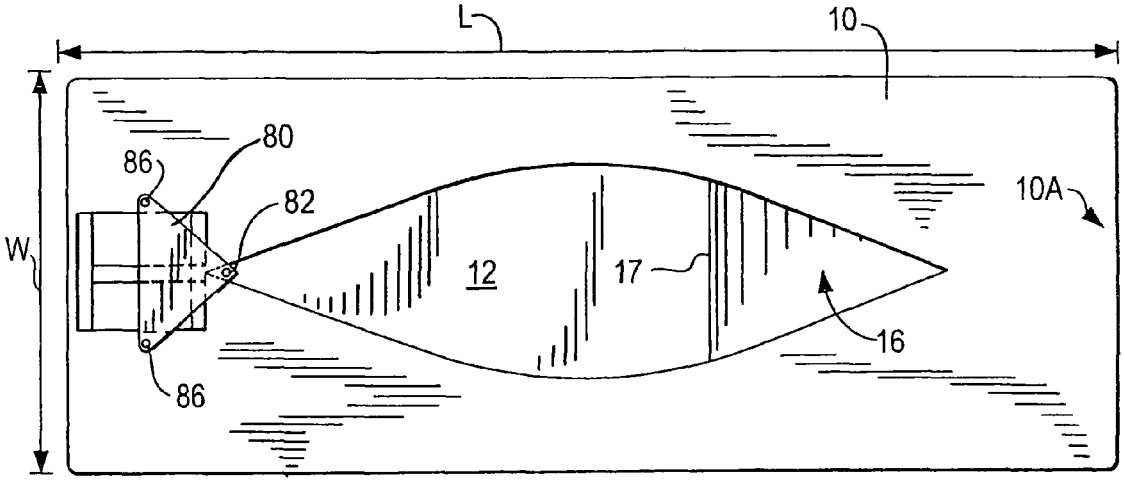
FIG. 9 is a bottom view of a second embodiment of the invention.
Figure 10:
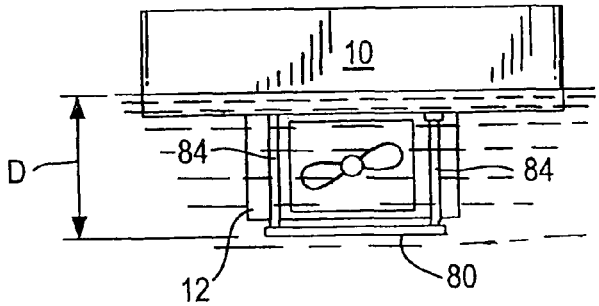
FIG. 10 is a rear elevation view of the boat of FIG. 9.

Referring again to FIGS. 9 and 10, the optional protective plate 80 is shown positioned below the propeller and attached to the bottom of the lower hull 12 by fastener 82 and to a pair of struts 84 depending from the bottom of upper hull 10 by fasteners 86. As best seen in FIG. 9, the plate 80 is generally triangular and is of sufficient thickness to resist bending upwardly to interfere with the free turning of the twin fins in the event of an impact. In order to further minimize unnecessary structural members extending from the hulls, the struts 84 and fastener 82 can be removably installed when the pushboat is to be operated without the protective plate.

The hulls of the invention can be constructed of common structural steel plate using techniques and equipment well known and available in boatyards. Fabrication can be accomplished easily and inexpensively, using basic welding procedures and equipment. As will be apparent to one of ordinary skill in the art, no special bending or machining is required. The propulsion engine can be installed in a simple, straightforward manner. The configuration of the hull portions provides for easy access to conventional packing glands and bearings for maintenance or repair. Tankage for fuel and other necessary lubricants can also be positioned for easy access and enables the vessel to be balanced and seaworthy under a variety of sea conditions. Fresh water keel cooling pipes can be mounted under the upper hull portion making them more efficient and less vulnerable to damage in collisions with underwater objects.

The flat bottom of the dual-tapered hull adds to the stability and seaworthiness of the craft, while also providing a stable platform that keeps the vessel upright when grounded intentionally, or removed to a dry dock or boatyard where it can be placed directly on its bottom surface without special supports or framing. This hull configuration also facilitates easier handling during transport over land by flatbed truck or trailer.

The invention results in improved fuel economy, better speed, more maneuverability and overall performance, less maintenance, reduced repair costs and a consequent dollar savings in time and labor costs.

While the configuration described herein is specifically directed to a hull and steering mechanism configuration for a pushboat, nothing disclosed herein should be construed as a limitation to applying the invention to other types of marine vessels.

While the preferred embodiment of the present invention has been shown and described, it will be understood that this embodiment is provided by way of example only. Numerous variations, changes and substitutions will occur to those of ordinary skill in the art without departing from the spirit and scope of this disclosure of the invention. Accordingly, it is intended that the invention be limited only by the appropriate interpretation of the claims that follow.

I claim:

1. A hull and steering mechanism for a marine vessel comprising:

an upper hull portion having a bow, a stern, two sidewall portions, a deck portion and a first bottom portion;

a lower dual-tapered hull portion disposed beneath the upper hull portion and having a bow portion, an aft portion, two sidewall portions and a second bottom portion;

a propeller extending from the dual-tapered lower hull portion; and a directional thrust steering mechanism surrounding the propeller at, or proximate the stern of the upper hull portion for steering the vessel, wherein the lowermost portion of the steering mechanism terminates at or above a plane defined by the second bottom portion, and wherein the steering mechanism is a directional thrust housing assembly comprised of:

two parallel vertical blades rotatable about a vertical axis and positioned outboard of the propeller, their lower edges extend to a depth below an arc defined by the propeller's rotation, wherein a major portion of the vertical blades extends aft of the vertical axis to provide directional thrust by diverting the water displaced by the propeller in a direction defined by the orientation of the blades; and at least two horizontal structural members extending at fore and aft portions between the lower edges of the vertical blades to maintain the vertical blades in parallel relation.

2. The hull and steering mechanism of claim 1, wherein the upper hull portion is generally rectangular in shape.

3. The hull and steering mechanism of claim 1, wherein the forward end of the upper hull portion defines a vertical, substantially planar, rectangular surface.

4. The hull and steering mechanism of claim 1, wherein the upper hull portion overhangs the periphery of the lower hull portion.

5. The hull and steering mechanism of claim 1, wherein the lower dual-tapered hull portion is elongated and the sidewall portions are generally vertical and taper inwardly from amidship, and are joined to define the bow and aft ends of the lower hull portion.

6. The hull and steering mechanism of claim 1, wherein the lower hull portion has a substantially flat bottom.

7. The hull and steering mechanism of claim 1, wherein the bow of the lower hull portion is displaced aft of the bow of the upper hull portion.

8. The hull and steering mechanism of claim 1, wherein a forward portion of the second bottom portion of the dual-tapered lower hull portion rises at an angle to the bow as a substantially flat, triangular surface.

9. The hull and steering mechanism of claim 1, wherein an aft portion of the lower dual-tapered hull portion is displaced inboard of the stern of the upper hull portion.

10. The hull and steering mechanism of claim 1, wherein the at least two horizontal structural members are positioned perpendicular to the two parallel vertical blades.

11. The hull and steering mechanism of claim 10, wherein the at least one horizontal structural member is configured to minimize hydrodynamic drag.

12. A hull and steering mechanism for a marine vessel comprising:

a generally rectangularly-shaped upper hull portion having a bow, a stern, two upper sidewall portions, a deck and a bottom portion positioned below a waterline;

an elongated dual-tapered lower hull portion having a bow portion, an aft portion, two lower sidewall portions and a bottom portion, the lower hull portion being attached to the first bottom portion of the upper hull portion, the bow portion of the lower hull portion being displaced aft of the bow of the upper hull portion, wherein the lower sidewall portions are joined along vertical lines at the bow and aft portions;

a propeller extending from the lower hull portion; and a steering mechanism mounted at, or proximate to the stern of the upper hull portion for steering the vessel in conjunction with a thrust of the propeller, wherein the lowermost portion of the steering mechanism terminates at or above a plane defined by the second bottom portion, and wherein the steering mechanism is a directional thrust housing assembly comprised of:

two parallel vertical blades rotatable about a vertical axis and positioned outboard of the propeller, their lower edges extend to a depth below an arc defined by the propeller's rotation, wherein a major portion of the vertical blades extends aft of the vertical axis to provide directional thrust by diverting the water displaced by the propeller in a direction defined by the orientation of the blades; and at least two horizontal structural members extending at fore and aft portions between the lower edges of the vertical blades to maintain the vertical blades in parallel relation.

13. The hull and steering mechanism of claim 12, wherein the bow of the upper hull portion forms a vertical, substantially flat, rigid rectangular surface extending transverse to a longitudinal axis of the vessel that is constructed for pushing other vessels.

14. The hull and steering mechanism of claim 12, wherein the bottom portion of the upper hull portion is below the vessel's waterline.

15. The hull and steering mechanism of claim 12, wherein the bottom portion of the lower hull portion is substantially flat and the bow portion of the lower hull portion is inclined and forms a substantially flat, triangular surface.

16. The hull and steering mechanism of claim 12, wherein the directional thrust housing assembly includes:

a plurality of structural linking members extending between the two parallel vertical rudder blades; and at least one steering and supporting member attached to at least one of the structural linking members.

17. The hull and steering mechanism of claim 16, wherein the plurality of structural linking members comprise a plurality of horizontal members extending between respective upper and lower edges of the rudder blades and the at least one steering and supporting member is a rotatable vertical shaft.

18. A hull for a marine vessel comprising:

a generally rectangular-shaped upper hull having a bow, a stern, two upper sidewall portions, a deck and a first bottom portion;

a dual-tapered lower hull having a bow portion, an aft portion, two lower sidewall portions and a second bottom portion, the lower hull being joined to the first bottom portion of the upper hull, the bow portion of the second bottom portion of the lower hull defining a triangular shaped section, a forward apex of which is displaced aft of the bow of the upper hull, wherein forward movement of the vessel produces a lifting force on the bow portion of the lower hull;

a propeller extending from the dual-tapered lower hull portion; and a directional thrust steering mechanism surrounding the propeller at, or proximate the stern of the upper hull portion for steering the vessel, wherein the lowermost portion of the steering mechanism terminates at or above a plane defined by the second bottom portion, and wherein the steering mechanism is a directional thrust housing assembly comprised of:

two parallel vertical blades rotatable about a vertical axis and positioned outboard of the propeller, their lower edges extend to a depth below an arc defined by the propeller's rotation, wherein a major portion of the vertical blades extends aft of the vertical axis to provide directional thrust by diverting the water displaced by the propeller in a direction defined by the orientation of the blades; and at least two horizontal structural members extending at fore and aft portions between the lower edges of the vertical blades to maintain the vertical blades in parallel relation.

19. A directional thrust steering assembly for use with a marine vessel having a propeller extending from an aft section of a submerged hull, the assembly comprising:

a. a pair of vertically disposed rudder blades displaced on either side of the propeller;

b. a plurality of linking members joined to, and extending between fore and aft portions of the upper and lower edges of the rudder blades that form an open framework to thereby maintain the rudder blades in a parallel configuration; and c. a vertically disposed steering shaft extending from the submerged hull above the propeller and engaging at least one of the linking members for rotation about an axis of the steering shaft.

20. The directional thrust steering assembly of claim 19 which further includes a stationary protective plate mounted to the submerged hull and extending horizontally to a position below the propeller, whereby the propeller is protected from contact with a ground below the marine vessel.

* * * * *